US005337039A

United States Patent [19]

Simon

[11] Patent Number: 5,337,039

[45] Date of Patent: Aug. 9, 1994

[54] PROXIMITY DETECTION SYSTEM WITH DIGITAL FREQUENCY VARIATION DETECTION MEANS

[75] Inventor: Arvin B. Simon, Cleveland, Ohio

[73] Assignee: SDR Metro Inc., Euclid, Ohio

[21] Appl. No.: 915,097

[22] Filed: Jul. 16, 1992

[51] Int. Cl.[5] ..... G08B 13/26

[52] U.S. Cl. ..... 340/562; 307/116; 331/65; 340/938; 340/939; 340/941

[58] Field of Search ..... 340/938, 939, 941, 562, 340/561; 307/116; 331/65

[56] References Cited

U.S. PATENT DOCUMENTS

| | | | |
|---|---|---|---|
| 3,346,856 | 10/1967 | Dobble et al. | 340/939 |
| 3,626,637 | 12/1971 | Rudicel et al. . | |
| 3,989,932 | 11/1976 | Koerner | 340/938 |
| 4,075,563 | 2/1978 | Battle | 340/939 |
| 4,103,252 | 7/1978 | Bobick | 331/48 |
| 4,169,260 | 9/1979 | Bayer | 340/562 |
| 4,240,528 | 12/1980 | Kraus | 187/52 R |
| 4,345,167 | 8/1982 | Calvin | 307/308 |
| 4,453,112 | 6/1984 | Sauer | 318/281 |
| 4,652,864 | 3/1987 | Calvin | 340/553 |
| 4,760,490 | 7/1988 | Murao | 361/181 |
| 4,794,273 | 12/1988 | McCullough et al. | 307/139 |
| 4,998,094 | 3/1991 | Englmeier et al. | 340/572 |
| 5,034,722 | 7/1991 | Premack | 340/562 |

*Primary Examiner*—Glen R. Swann, III

*Attorney, Agent, or Firm*—Gifford, Groh, Sprinkle, Patmore and Anderson

[57] ABSTRACT

An oscillator which produces a continuous wave output signal on an antenna having a preset frequency. A detection circuit detects changes in the preset frequency resulting from proximity between the antenna and an object and when such an object is detected, the detection circuit generates an output signal. A compensation circuit is also provided for compensating for changes of the preset frequency which are caused by factors other than proximity of the antenna with an object. Such other factors include radio frequency interference, long term component degradation, temperature, and the like.

19 Claims, 2 Drawing Sheets 42
58
470K
56
54
52
40
70
10K
4.7K
44
48
38
30
OUT
68
66
10MEG
50
64
62
2.2K
60
46
36
26
34
24
50
18
10K
10K
22
100K
32

PROXIMITY DETECTION SYSTEM WITH DIGITAL FREQUENCY VARIATION DETECTION MEANS

BACKGROUND OF THE INVENTION

1. Field of the Invention

There are a number of previously known proximity detection systems for detecting the proximity between an object and a transmitting antenna. For example, such systems can be used on vehicle gates and the like to prevent the vehicle gate from contacting a vehicle, person or other object as the gate is moved from a raised to a lowered position.

2. Description of the Prior Art

Many of these previously known proximity detection systems utilize an oscillator which transmits a high frequency signal to the antenna. Proximity between an object and antenna changes the capacitance of the antenna and thus the frequency of the oscillator. The change of frequency of the oscillator is detected by other circuitry which then generates an appropriate output signal.

These previously known proximity detection systems, however, have not proven wholly satisfactory in use. One major disadvantage of these previously known systems is that factors other than proximity between the antenna and an object causes changes in the oscillator frequency and thus false triggering of the output signal. For example, radio frequency interference,, component degradation, ambient temperature and the like can all cause changes in the oscillator frequency and result in false triggering of the system.

A still further disadvantage of these previously known proximity detection systems is that it was difficult, if not impossible, to adjust the sensitivity of the system. Thus, it was not possible to adjust the closeness or proximity between the antenna and the object before triggering of the system would occur. However, in many situations, it is desirable to trigger the output signal caused by proximity between the antenna and the object at relatively great distances, for example several feet, while, conversely, in other situations it is desirable to trigger the system when there is very close proximity, for example a few inches, between the antenna and the object.

SUMMARY OF THE PRESENT INVENTION

The present invention provides a proximity detection system which overcomes all of the above mentioned disadvantages of the previously known devices.

In brief, the proximity detection system of the present invention comprises an oscillator which generates a relatively high frequency signal to an antenna. Preferably, this high frequency signal is in the range of one megahertz and the signal itself is a sawtooth or triangle wave.

The output from the oscillator is also connected to the clock input of a ripple counter so that the counter counts in unison with the oscillator. A voltage controlled oscillator, however, is connected to the reset input of the counter so that the VCO continuously and iteratively resets the counter after a predetermined number of cycles, for example one thousand cycles. Thus, the ratio of the voltage control oscillator to the antenna oscillator is 1000 to 1.

In the event that the frequency of the antenna oscillator changes, as would happen when the antenna comes into proximity with an object, the counter generates an error signal or pulse or series of pulses for each waveform from the main sensing oscillator and from the VCO having a width which is proportional to the change in the frequency of the main oscillator. The output error pulse from the counter is delayed, both by an RC circuit, and by an integrator before being converted to a correction signal by the VCO.

After the first RC delay, a second delay is added by the integrator. When the error pulse from the counter is created and delayed, it is then integrated. When the integrated amount exceeds a predetermined threshold over a delayed period of time, an output signal is generated indicative either of proximity between an antenna and an object over an extended period of time, for example, several minutes or several seconds of a background drift change such as temperature or other environmental factors.

The delays caused by the RC circuit and integrator only create a correction signal after significant delays of error detection and, therefore, only correct slow term drift caused by temperature, parts aging and the like, not sudden changes which only last for a half second or a couple seconds which then go back to normal background, such as a car or hand or person walking by.

The present invention also utilizes a variable resistor and capacitor combination electrically connected to the output from the counter in order to provide a sensitivity adjustment for the proximity detection system. This resistor capacitor combination is also the first of the two error pulse signal delays to the VCO. It is the first delay from the counter and feeds the second delay which is the integrator. These delays control sensitivity since longer compensation delays allow errors to exist for a long time, one or two seconds, long enough to be detected by the alarm circuit before the errors can be compensated for by the VCO. Without these delays, the VCO would compensate for any outside error within a few milliseconds and errors would, therefore, not last long enough to set off the alarm detector circuit and would, therefore, not be able to sense a car or hand motion near the antenna.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
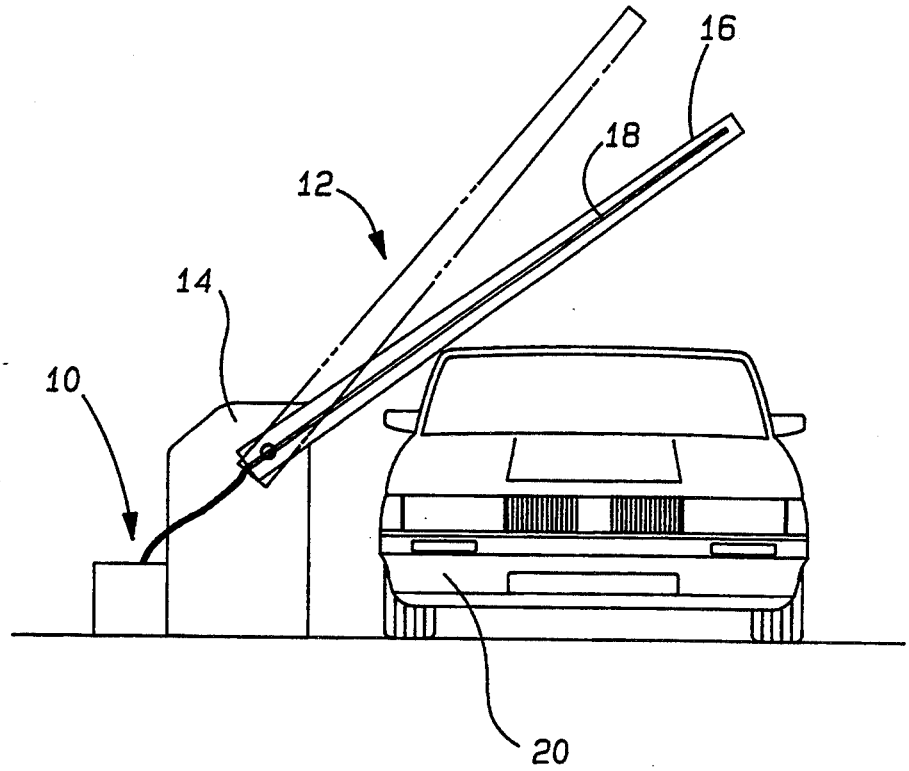
FIG. 1 is a diagrammatic view illustrating the operation of the system of the present invention.

With reference first to FIG. 1, a preferred embodiment of the proximity detection system 10 of the present invention is thereshown for use with a vehicle gate 12. The vehicle gate 12 includes an upright support 14 and a gate 16 extending outwardly from the support 14. The gate 16 is movable between an upper position, illustrated in phantom line, and a lower position, illustrated in solid line. An antenna 18 is mounted to the gate 16 and is electrically connected to the detection system 10.

In a fashion which will be subsequently described in greater detail, as the gate 16 approaches an object 20, such as a car, the system 10 will detect the proximity of the object 20 and move the gate 16 to its raised position to prevent contact between the gate 16 and the object 20.

Figure 2:
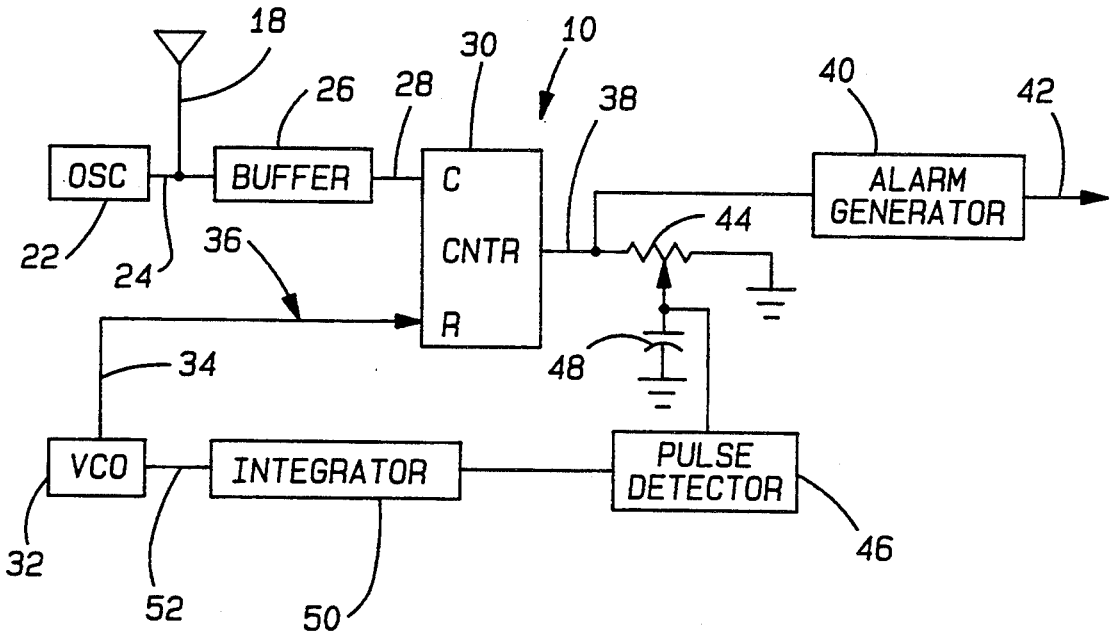
FIG. 2 is a block diagram view of a preferred embodiment of the present invention.

With reference now to FIG. 2, a block diagrammatic view of the proximity detection system 10 is thereshown and comprises an oscillator 22 having its output 24 connected to the antenna 18. The oscillator 22, furthermore, oscillates at a preset high frequency, for example one megahertz.

The output 24 of the oscillator 22 is also connected through a buffer 26 to the clock input 28 of a counter 30. The counter 30 preferably a ripple counter having fourteen stages.

The system 10 also includes a voltage controlled oscillator 32 having its output 34 connected to a reset input 36 of the counter 30. The voltage controlled oscillator oscillates at a second preset frequency, for example one kilohertz, so that the ratio between the frequency of the oscillator 22 and the frequency of the VCO 32 is preset for example 1000:1.

Consequently, assuming that the oscillator 22 oscillates at 1 megahertz and the VCO 32 oscillates at 1000 hertz, the oscillator 22 provides 1000 output pulses to the counter clock input 28 at which time the output from the VCO 32 resets the counter 30 and, thereafter, the process is continuously repeated. As long as this preset ratio, e.g. 1000:1, is maintained, the counter 30 does not provide a signal on its overflow output 38.

Conversely, when the frequency of the oscillator 22 changes, as would occur due to the change in capacitance caused by proximity between the antenna 18 and the object 20 (FIG. 1) the counter 30 generates output pulses on its overflow output 38 having a width proportional to the frequency change of the oscillator 22. These output pulses from the counter 30 are connected as an input signal to an alarm generator 40 which stretches very small error pulses from counter 30 into very long pulses and generates long enough time periods in time duration on output 42 to be detectable by slower logic circuits connected to 42 when the rate of change of the frequency of the oscillator 22 exceeds a threshold value.

The output 38 from the counter 30 is also connected through a variable resistor 44 to a pulse detector 46. A capacitor 48 delays the output pulses from the counter 30 while the pulse detector 46 similarly further lengthens and delays the output pulses from the counter 30.

The output from the pulse detector 46 is connected as an input signal to an integrator 50 which integrates the voltage pulses from the counter 30 and also delays the output 38 from the counter 30. An output 52 from the integrator 50 is connected as an input to the VCO 32 to vary the voltage, and thus the frequency, of the VCO 32.

The pulse detector 46, integrator 50 and VCO 32 all serve to slowly compensate for variations of the frequency of the oscillator 22 which are caused by long term proximity between the antenna 18 and an object or by factors other than proximity between the antenna 18 and the object 20. Such extraneous factors which can alter the frequency of the oscillator 22 include part degradation, radio frequency interference, ambient temperature and other factors.

The compensation circuit formed by the pulse detector 46, integrator 50 and VCO 32 thus forces the VCO 32 to maintain the preset ratio between the frequency of the VCO 32 and the frequency of the oscillator 22. However, the delay imposed by both the pulse detector 46 when capacitor 62 (FIG. 3) is used and integrator 50 ensures that only relatively long term frequency variations will be compensated while relatively short term frequency variations of the oscillator 22 i.e. frequency variations which would be caused by proximity between the antenna 18 and the object 20, are detected by the alarm generator 40 in the desired fashion. Short term frequency variations are characterized by a rate of change of the oscillator 22 frequency greater than a predetermined amount while the rate of change of the oscillator 22 frequency for long term variations is less than this predetermined amount.

There is a second technique of rejecting frequency noise Many forms of noise will cause alternately temporarily too low and then temporarily too high input frequency. This would cause no average change in the counter. For example, if out of 1000 cycles, the first 500 had 100 cycles added then there would be a greater likelihood that the next 500 cycles would be 100 cycles too low which would mean that 1000 cycles would still average 1000 cycles.

Figure 3:
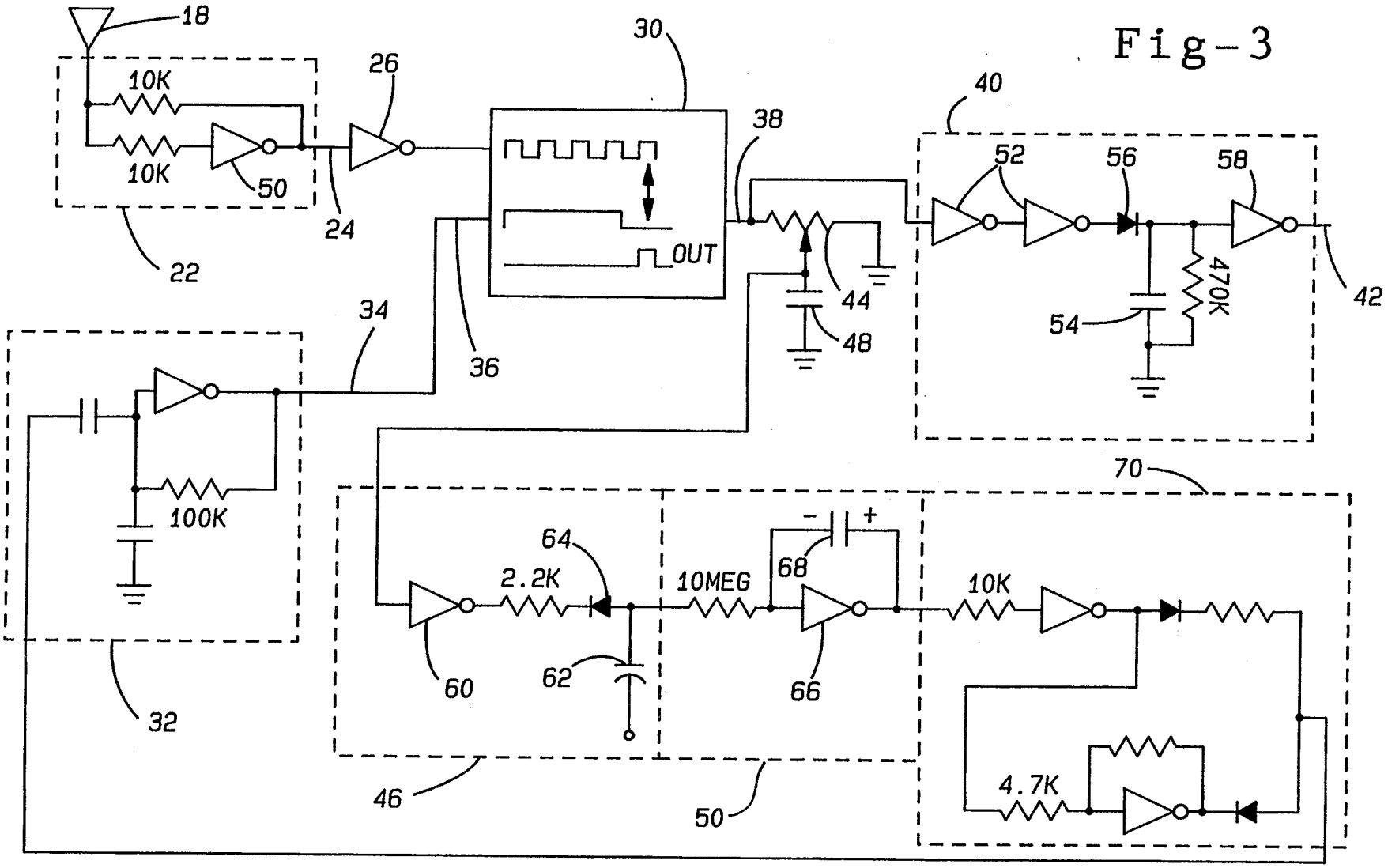
FIG. 3 is a schematic view of the preferred embodiment of the present invention.

With reference now to FIG. 3, a schematic diagram of the preferred embodiment is thereshown. In FIG. 3, the oscillator 22 provides a near-saw-tooth wave to the antenna while simultaneously providing a square wave output to the next stage. Any amplitude or spike noise which is injected to the antenna cannot create more than a square wave on the output since a Schmitt trigger output can only be a square wave. This effectively reduces sensitivity to amplitude noise at the input The frequency of the oscillation is set to a preselected frequency, preferably one megahertz.

As previously described, the output 24 from the oscillator 22 is fed through the buffer 26 to the clock input of the counter 30. The overflow output 38 from the counter 30 is connected to the input of the alarm generator 40. The alarm generator 40 utilizes two digital buffers 52 to amplify the overflow output from the counter 30 and the output from the buffers 52 are utilized to charge a capacitor 54 through a diode 56. The capacitor 54 and diode 56 are also connected as an input signal to a further analog amplifier 58 which is configured as a Schmitt trigger. The use of the capacitor 54, however, is optional and it may be omitted from the circuit. Thus, whenever the voltage on the capacitor 54 exceeds a predetermined threshold, the amplifier 58 switches and provides the output signal on the output 42 from the alarm generator 40. This output signal is indicative of proximity between the object 20 and the antenna 18.

The output pulses, if present, on the counter output 38 are also used to charge the capacitor 48. Since the capacitor 48 is connected to the variable resistor 44, the adjustment of the variable resistor 44 controls the RC constant of the capacitor 48 and resistor 44 combination and thus the rate of charge of the capacitor 48. This forms a sensitivity adjustment for the proximity detection system 10. The resistor 44 forms a means for varying the threshold.

The pulse detector 46 comprises a pulse reshaper which is also a form of analog wave to pulse converter and amplifier 60 which is used to charge a capacitor 62, when used, through a diode 64 and/or charges a capacitor in the integrator 50. The pulse detector 46 both amplifies and rectifies any pulses from the counter 30.

The integrator 50 integrates the output pulses from the pulse detector 46 by an amplifier 66 which charges a capacitor 68.

The stored voltage on the capacitor 68 is connected as an input signal to an amplifier and buffer circuit 70 which has its output connected to the input of the VCO 32. The buffer circuit 70 includes two diodes 71 and 73 which, by selectively conducting, vary the resistance between a capacitor 75 in the VCO and ground and thus the frequency of the VCO. Applying variable voltages to the input gate of block 70 (voltage-to-resistance converter) variably controls resistance of diodes by changing their on and off current which in turn changes the RC time constant and thus the frequency of the oscillator of block 32. Thus the frequency of the VCO 32 is dependent upon the voltage from the amplifier to the buffer circuit 70. Similarly, as previously described, the output 34 from the VCO 32 is connected to the reset input 36 of the counter 30.

In operation and assuming that the antenna 18 is not in proximity with the object 20, the oscillator 22 oscillates at its preset frequency, one megahertz, while the VCO 32 oscillates at its preset frequency of one kilohertz. Thus, the VCO 32 resets the counter 30 for every 1000 pulses from the oscillator 22. In doing so, the counter 30 does not generate an output signal on its overflow output 38.

There are many factors, such as radio frequency interference, temperature, part degradation and the like, which will cause the oscillator 22 to oscillate at a different frequency. Such changes in frequency are relatively slow and small changes so that the rate of change of the oscillator frequency 22 is relatively small. However, when the frequency of the oscillator 22 does change, the VCO 32 and oscillator 22 are no longer in synchronism with each other so that the counter 30 generates an output signal on its overflow output 38. The output pulses on the overflow output 38, however, are insufficient to exceed the threshold value of the alarm generator 40. Consequently, the alarm generator 40 does not provide a signal on its output 42.

The output signal from the counter 38, however, is both amplified and integrated by the pulse detector 46 and integrator 50 and is used to vary the frequency of the VCO 32. By thus varying the frequency of the VCO 32, the ratio between the frequency of the VCO 32 and the frequency of the oscillator 22 is returned to 1000:1. In doing so, since the VCO 32 and oscillator 22 are again in synchronism with each other, the counter 32 does not generate pulses on its output 38.

Unlike the relatively small rate of change of the frequency of the oscillator 32 which results from RFI and long term conditions, when the antenna 18 approaches an object 20 (FIG. 1) the frequency of the oscillator 22 changes abruptly and rapidly due to the chance of capacitance of the antenna 18. When this occurs, the counter 32 generates relatively wide pulses on its output 38 which are integrated by the amplifiers 52 and capacitor 54 in the alarm generator 40 until the voltage on the capacitor 54 exceeds a threshold value of the Schmitt trigger 58. When this occurs, the alarm generator 40 generates a signal on its output 42 which can be used, for example, to reverse the motor direction of the vehicle gate 12.

In the preferred embodiment of the invention, the alarm generator 40 responds to changes in frequency of the oscillator 22 which occur within a relatively short time period, e.g. 0.5 seconds. Conversely, the delay caused by the pulse detector 46 and integrator 50 delays the response of the compensation circuit for the VCO 32 by a relatively longer period of time, for example 0.75 seconds. Thus, immediate compensation of frequency change of the oscillator 22 is prevented.

From the foregoing, it can be seen that the present invention provides a proximity detection system with automatic compensation which is simple and inexpensive in construction and yet effective in operation. Having described my invention, however, many modifications thereto will become apparent to those skilled in the art to which it pertains without deviation from the spirit of the invention as defined by the scope of the appended claims.

I claim:

1. A proximity detection system comprising:

an antenna, oscillator means for producing a continuous wave signal of a preset frequency and for connecting said continuous wave signal to said antenna, means for detecting changes in said preset frequency having a rate of change greater than a predetermined amount, means responsive to said detecting means for generating an output signal, means for automatically compensating for frequency variations of said oscillator means having a rate of frequency change less than said predetermined amount, wherein said detecting means comprises a counter having an input connected to said continuous wave signal, means for producing a reset signal having a second preset frequency, said second frequency being less than said first preset frequency, means for connecting said reset signal to a reset input of said counter, whereby said counter generates an output signal indicative of changes in said first preset frequency.

2. The invention as defined in claim 1 and further comprising means for generating a square wave pulsed signal.

3. The invention as defined in claim 2 wherein said square wave generating means comprises a Schmitt trigger.

4. The invention as defined in claim 1 wherein said counter is a ripple counter.

5. The invention as defined in claim 1 wherein said responsive means comprises means for accumulating said output signal and for producing an accumulating output signal representative thereof, and means for detecting when said accumulating output signal exceeds a predetermined threshold.

6. The invention as defined in claim 5 wherein said accumulating means comprises a capacitor having one side connected to said output signal and a Schmitt trigger, said output signal charging said capacitor.

7. The invention as defined in claim 5 and comprising means for varying said threshold.

8. The invention as defined in claim 1 wherein said compensating means comprises means for varying the frequency of said reset signal.

9. The invention as defined in claim 8 wherein said reset signal producing means comprises a voltage controlled oscillator and wherein said reset frequency varying means comprises means for integrating said output signal and for producing a compensation signal representative thereof, and means for connecting said compensation signal as an input signal to said voltage controlled oscillator.

10. The invention as defined in claim 9 and comprising an amplifier/buffer circuit interposed between said integrator and said voltage controlled oscillator.

11. A proximity detection system comprising:

an antenna, oscillator means for producing a continuous wave signal of a preset frequency and for connecting said continuous wave signal to said antenna, means for detecting changes in said preset frequency having a rate of change greater than a predetermined amount, means responsive to said detecting means for generating an output signal, wherein said detecting means comprises a counter having an input connected to said continuous wave signal, means for producing a reset signal having a second preset frequency, said second frequency being less than said first preset frequency.

means for connecting said reset signal to a reset input of said counter, whereby said counter generates an output signal indicative of changes in said first preset frequency.

12. The invention as defined in claim 11 and further comprising means for generating a square wave pulsed signal.

13. The invention as defined in claim 12 wherein said square wave generating means comprises a Schmitt trigger.

14. The invention as defined in claim 11 wherein said counter is a ripple counter.

15. The invention as defined in claim 11 wherein said responsive means comprises means for integrating said output signal and for producing an integrator output signal representative thereof, and means for detecting when integrator output signal exceeds a predetermined threshold.

16. The invention as defined in claim 15 wherein said integrating means comprises a capacitor having one side connected to said output signal and a Schmitt trigger, said output signal charging said capacitor.

17. The invention as defined in claim 15 and comprising means for varying said threshold.

18. The invention as defined in claim 11 wherein said reset signal producing means comprises a voltage controlled oscillator and wherein said reset frequency varying means comprises means for integrating said output signal and for producing a compensation signal representative thereof, and means for connecting said compensation signal as an input signal to said voltage controlled oscillator.

19. The invention as defined in claim 18 and comprising an amplifier/buffer circuit interposed between said integrator and said voltage controlled oscillator.

* * * * *

UNITED STATES PATENT AND TRADEMARK OFFICE

CERTIFICATE OF CORRECTION

PATENT NO. : 5,337,039

DATED : August 9, 1994

INVENTOR(S) : Arvin B. Simon

It is certified that error appears in the above-indentified patent and that said Letters Patent is hereby corrected as shown below:

Abstract, line 1, delete "which".

Abstract, line 5, after "and" insert —,—.

Column 1, line 28, delete ",", third occurrence.

Column 3, line 15, after "30" insert —is—.

Column 3, line 23, after "preset" insert —,—.

Column 3, line 35, after "(FIG. 1)", insert —,—.

Column 4, line 7, after "22" insert —,—.

Column 4, line 17, after "noise" insert —.—.

Column 4, line 21, after "added" insert —,—.

Column 4, line 33, after "input" insert —.—.

Column 4, line 64, "wave to pulse" should be —wave-to-pulse—.

UNITED STATES PATENT AND TRADEMARK OFFICE

CERTIFICATE OF CORRECTION

PATENT NO. : 5,337,039

DATED : August 9, 1994

INVENTOR(S) : Arvin B. Simon

It is certified that error appears in the above-indentified patent and that said Letters Patent is hereby corrected as shown below:

Column 7, line 22, delete "." insert --,--.

Signed and Sealed this

Seventeenth Day of October, 1995

Bruce Lehman

*Attest:*

BRUCE LEHMAN

*Attesting Officer*

*Commissioner of Patents and Trademarks*